US005796916A

United States Patent [19]

Meredith

[11] Patent Number: 5,796,916

[45] Date of Patent: Aug. 18, 1998

[54] METHOD AND APPARATUS FOR PROSODY FOR SYNTHETIC SPEECH PROSODY DETERMINATION

[75] Inventor: Scott E. Meredith, San Francisco, Calif.

[73] Assignee: Apple Computer, Inc., Cupertino, Calif.

[21] Appl. No.: 451,617

[22] Filed: May 26, 1995

Related U.S. Application Data

[63] Continuation of Ser. No. 8,958, Jan. 21, 1993, abandoned.

[51] Int. Cl.[6] ..... G10L 5/02

[52] U.S. Cl. ..... 395/2.67; 395/2.16; 395/2.69; 395/2.85; 395/2.87

[58] Field of Search ..... 395/2, 2.1, 2.14, 395/2.15, 2.16, 2.2, 2.67, 2.69, 2.76, 2.77, 2.75, 2.79, 2.85, 2.87; 381/51–53

[56] References Cited

U.S. PATENT DOCUMENTS

| | | | |
|---|---|---|---|
| 3,704,345 | 11/1972 | Coker et al. | 395/2.75 |
| 4,731,847 | 3/1988 | Lybrook et al. | 395/2.69 |
| 4,802,223 | 1/1989 | Lin et al. | 395/2.16 |
| 5,151,998 | 9/1992 | Capps | 395/100 |
| 5,278,943 | 1/1994 | Gasper et al. | 395/2 |

*Primary Examiner*—Allen R. MacDonald
*Assistant Examiner*—Robert C. Mattson
*Attorney, Agent, or Firm*—Carr & Ferrell, LLP

[57] ABSTRACT

In a synthetic speech system intonation of a natural utterance is automatically applied to a synthesized utterance. The present invention applies the desired intonation of the natural utterance to the synthesized utterance by aligning voicing sections of the natural utterance to the synthesized utterance. The voicing sections are initially delineated by voiced versus unvoiced, based on default voicing specifications for the synthetic utterance and on pitch tracker analysis of the natural utterance, and an attempt is made to align individual sections thereby. If no initial alignment occurs then a further attempt is made by varying the default voicing specifications of the synthesized utterance. If alignment is still not achieved, then each of the utterances, natural and synthetic, is considered a single large voicing section, which thus forces alignment therebetween. Once alignment occurs, the intonation of the natural utterance is applied to the synthetic utterance thereby providing the synthetic utterance with the desired, more natural, intonation. Further, the synthetic utterance having intonation specification can be graphically displayed so that the user may view and interactively and graphically modify the intonation specification for the synthetic utterance.

24 Claims, 5 Drawing Sheets

| Figure 4A |
| --- |
| Figure 4B |

METHOD AND APPARATUS FOR PROSODY FOR SYNTHETIC SPEECH PROSODY DETERMINATION

This is a continuation of application Ser. No. 08/008,958, filed Jan. 21, 1993 now abandoned.

CROSS REFERENCE TO RELATED APPLICATIONS

This application is related to co-pending patent application having Ser. No. 08/007,306, entitled "INTERFACE FOR DIRECT MANIPULATION OF SPEECH PROSODY," having the same inventive entity, assigned to the assignee of the present application, and filed with the United States Patent and Trademark Office on the same day as the present application.

This application is related to co-pending patent application having Ser. No. 08/006,880, entitled "METHOD AND APPARATUS FOR AUTOMATIC ASSIGNMENT OF DURATION VALUES FOR SYNTHETIC SPEECH," having the same inventive entity, assigned to the assignee of the present application, and filed with the United States Patent and Trademark Office on the same day as the present application.

FIELD OF THE INVENTION

The present invention relates to the field of synthetic speech generation. More particularly, the present invention relates to automatically assigning intonation values to a given synthesized utterance based on a natural utterance, and a graphical intonation editor to allow a user to further customize the intonation of synthetic speech.

BACKGROUND OF THE INVENTION

Intonation (or 'prosody' as it's often referred to in the art), as provided for in most text-to-speech systems, generally has three components: 1) the pitch of the synthetic voice (roughly corresponding to vocal fold vibration rates in natural speech); 2) the duration of speech segments (e.g., how long the 'AE' is in the phonetic symbol sequence 'k.AE.t' derived from the text input 'cat'); and 3) the location and duration of any pauses (silence) that may be inserted in a given synthetic speech stream.

Text-to-speech systems usually incorporate rules that attempt to predict natural intonational attributes that are in harmony with the nature of text submitted for synthetic output. However, these rule systems are severely constrained in the current state of the art by the lack of sufficiently powerful language understanding mechanisms. Thus, without knowledge of the real intent of the author of a given passage, the synthesized intonation produced by prior art systems frequently sound robotic, wooden and otherwise unnatural.

Furthermore, it is oftentimes the case that a user of a text-to-speech system expects a particular text to be rendered with a particular, definite intonational pattern. Prior art speech synthesizers have provided for the customization of the prosody of synthetic speech, generally using either high-level or low-level controls. The high-level controls generally include text mark-up symbols, such as a pause indicator. An example of prior art high-level text mark-up phonetic controls is taken from the Digital Equipment Corporation DECtalk DTC03 (a commercial text-to-speech system) Owner's Manual where the input text string:

It's a mad mad mad mad world.

can have its prosody customized as follows:

It's a |/|mad|\| mad |/|mad|\| mad |^|world.

where |/| indicates pitch rise, and |\| indicates pitch fall.

Some prior art synthesizers also provide the user with direct control over the output duration and pitch of phonetic symbols. These are the low-level controls. Again, examples from DECtalk:

[ow<1000>]

causes the sound [ow] (as in "over") to receive a duration specification of 1000 milliseconds (ms); while

[ow<,90>]

causes [ow] to receive its default duration, but it will achieve a pitch value of 90 hertz (Hz) at the end; while

[ow<1000,90>]

causes [ow] to be 1000 ms long, and to be 90 Hz at the end.

The disadvantage of the high-level controls is that they give only a very approximate effect. It may be impossible to achieve the desired intonational effect with such a coarse control mechanism.

The disadvantage of the low-level controls is that even the intonational specification for a single utterance can take many hours of expert analysis and testing (trial and error), including measuring and entering detailed Hz and ms specifications by hand.

By contrast, the present invention is completely intuitive. All that is needed is a spoken sample of the desired intonation. Typically, speakers can produce natural intonation that they would find very hard to describe by means of symbols. With the present invention, all they need to do is speak what they want. It is a kind of "what you speak is what you get" ("WYSIWYG") mechanism for text-to-speech control. Furthermore, it's also a kind of "what you hear is what you get" ("WYHIWYG") mechanism when the spoken sample comes from a source other than the user's own speech.

Furthermore, prior art systems for graphical display and control of speech intonation have lacked the capability to affect more than mere amplitude of the utterance. For example, SoundEdit® (trademark of Farallon Computing, Inc.) allows the user to alter the amplitude or tempo of a portion of a (or pitch of an entire) given utterance graphically displayed but lacks the ability to display and customize symbolic forms of speech and lacks the ease of change and correction of synthesized intonation as does the present invention.

SUMMARY AND OBJECTS OF THE INVENTION

It is an object of the present invention to provide a synthetic speech utterance with a more natural intonation.

It is a further object of the present invention to provide a synthetic speech utterance with a desired intonation based on a recorded natural utterance having the desired intonation.

It is a still further object of the present invention to provide a method for viewing and editing intonation of synthetic speech in a graphical and intuitive manner.

It is an even further object of the present invention to provide an apparatus for viewing and editing intonation of synthetic speech in a graphical and intuitive manner.

The foregoing and other advantages are provided by a method for intonation specification in a synthetic speech system comprising aligning one or more voicing sections of a natural utterance to one or more voicing sections of a phonetic text stream and applying intonation of the one or more voicing sections of the natural utterance to the one or more voicing sections of the phonetic text stream.

The foregoing and other advantages are also provided by an apparatus for intonation specification in a synthetic speech system comprising means for aligning one or more voicing sections of a natural utterance to one or more voicing sections of a phonetic text stream and means for applying intonation of the one or more voicing sections of the natural utterance to the one or more voicing sections of the phonetic text stream.

Other objects, features and advantages of the present invention will be apparent from the accompanying drawings and from the detailed description which follows.

BRIEF DESCRIPTION OF THE DRAWINGS

The present invention is illustrated by way of example and not limitation in the figures of the accompanying drawings, in which like references indicate similar elements, and in which.

DETAILED DESCRIPTION OF THE INVENTION

Figure 1:
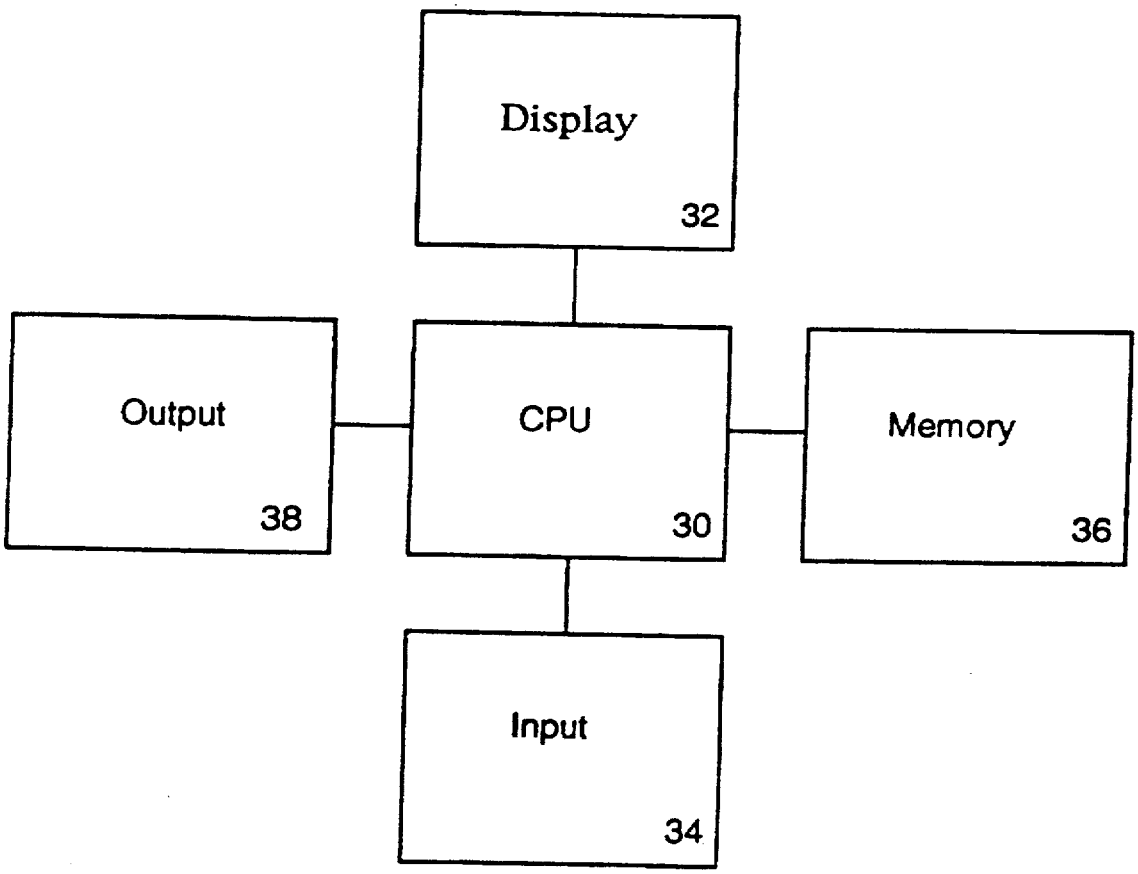
FIG. 1 is a block diagram of a computer system for the present invention.

The invention will be described below by way of a preferred embodiment as an improvement over the aforementioned text-to-speech and graphical sound display and edit systems, and implemented on an Apple Macintosh® (trademark of Apple Computer, Inc.) computer system. It is to be noted, however, that this invention can be implemented on other types of computers. Regardless of the manner in which the present invention is implemented, the basic operation of a computer system embodying the present invention, including the software and electronics which allow it to be performed, can be described with reference to the block diagram of FIG. 1, wherein numeral 30 indicates a central processing unit (CPU) which controls the overall operation of the computer system, numeral 32 indicates an optional standard display device such as a CRT or LCD, numeral 34 indicates an optional input device which may include both a standard keyboard and a pointer-controlling device such as a mouse, numeral 36 indicates a memory device which stores programs according to which the CPU 30 carries out various predefined tasks, and numeral 38 indicates an optimal output device which may include a speaker for playing improved speech generated by the present invention.

Figure 2:
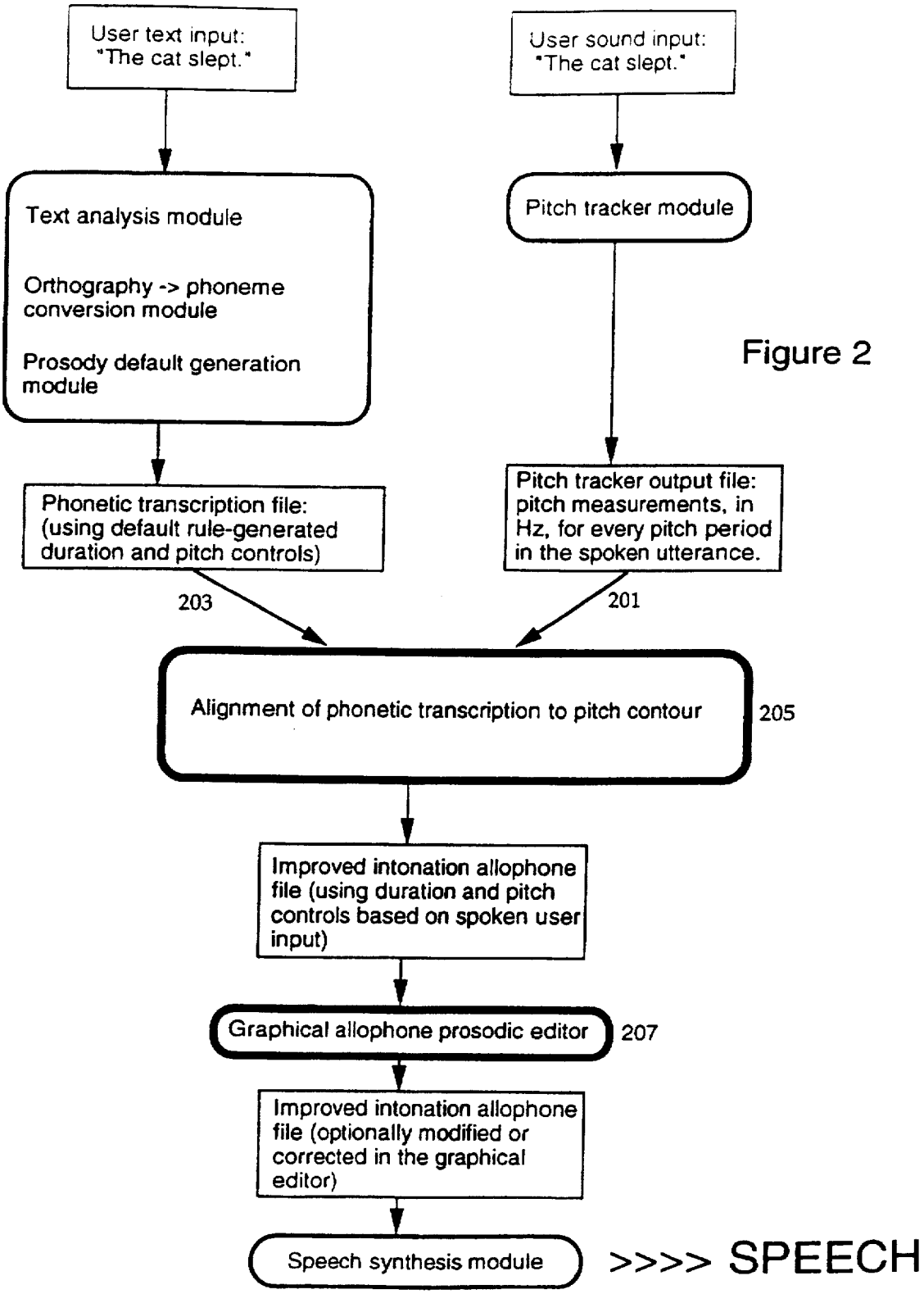
FIG. 2 is a simplified flowchart for the operation of the present invention.

The present invention provides a simple, powerful, and convenient approach for allowing a user to specify "custom" intonation, of their own choosing, to a given synthetic utterance. Referring now to FIG. 2, the preferred embodiment system of the present invention accepts two inputs. One input 201 is a list of fundamental frequency measurements made at some reasonable interval (for example, a single pitch period as is well known in the art), of a naturally generated utterance (i.e. spoken by a human being) as measured by a pitch tracker.

Note that the segment length of the sample natural utterance, in the preferred embodiment of the present invention, is limited to a single sentence or statement. Natural utterances of greater lengths could be used with the approach of the present invention provided that sufficient processing power is available. And natural utterances of lesser lengths could likewise be used, however, generally speaking, utterances of at least one sentence or statement (which may, however, include only a single word) are preferable in order to obtain enough contextual information to properly generate the default intonational values.

The other input 203 to the present invention is a phonetic transcription of the same sentence resulting from the text-to-phonetics conversion operation of a text-to-speech system. For example, the phonetic transcription for the text input 'hello' might be 'h.EH.l.OW'. The phonetic symbols are accompanied by duration values (in milliseconds), derived by the default duration rules of the text-to-speech system's text-to-phonetics conversion system.

The goal of the present invention 205 is to take the phonetic symbols and place duration and pitch controls onto them based on a pitch tracker's analysis of the prosody of the natural utterance. This results in the utterance being spoken by the synthetic voice having a more natural pitch contour. Note that this is particularly useful for quick and easy customization of pitch contours and duration values of special purpose speech (e.g. greetings or warnings), where the text-to-speech system's default prosody rules are insufficiently sophisticated, or where the semantics of the utterance are difficult for the system to analyze correctly.

The present invention first attempts to align stretches of voiced and unvoiced speech from the natural utterance, as detected by the pitch tracker, with stretches of voiced and unvoiced phonetic symbols in the phonetic symbol transcript. Where the number of such voicing sections is identical in the original, unaltered phonetic transcript and the pitch tracker output, the pitch tracker pitch measurements from each voicing section are applied to each successive phonetic symbol in the corresponding transcript, at reasonable intervals (every $n^{th}$ pitch point is applied, depending upon the synthesizer's bandwidth, and in the preferred embodiment of the present invention n is usually between 2 and 5, inclusive). The new phonetic symbol duration values are determined by calculating each symbol's percentage of the total duration of the symbol transcript voiced section, and then using that percentage of the pitch tracker voiced section as that symbol's new duration value.

Further, in the preferred embodiment of the present invention, if the voiced sections of the pitch tracker output do not match the number of voiced sections in the phonetic symbol transcript, alternative possible transcript voiced sections are proposed. These alternative possible transcript voiced sections are derived from the phonetic symbol transcript and a listing of which phonetic symbols may have variable voicing characteristics. These alternative voicing possibilities are variable because in real speech, certain phonetic segments are sometimes voiced and sometimes not voiced.

In this situation, in the preferred embodiment of the present invention, every permutation of voicing possibilities for the variable-voicing phonetic symbols occurring in the given utterance is attempted, and the best match (again, between the pitch tracker output sections and the phonetic symbol transcript sections) is determined using a metric that involves duration proximity to synthesized voiced sections, how many segments had to change from their original, default voicing specification, and other factors as explained more fully below.

Finally, in the preferred embodiment of the present invention, in case no reasonable alignment can be found, the pitch contour for the utterance as a whole, from start to end, is applied to the phonetic symbol transcript as a whole. The duration values are taken as percentages of the duration of the entire natural utterance.

What follows is a detailed example of the approach of the present invention for a sample utterance:

text form of utterance: "Hi, Bob."

The synthesizer, using its default intonational rules, generates the following intermediate (pre-speech) output:

| | | | |
|---|---|---|---|
| Sent | 06 | | |
| Word | 02 | | |
| h | \|90\| | p170:0 | |
| AY | \|225\| | p175:100 | |
| Word | 33 | | |
| b | \|98\| | p172:50 | |
| AA | \|189\| | p169:5 | p132:100 |
| b- | \|99\| | p125:50 | |
| % | \|1\| | | |

The 'Sent' and 'Word' lines are for synchronization of text positions with the speech when output. The other lines start with a phonetic symbol (e.g. 'AA'). After the phonetic symbol, on the same line, is the duration in milliseconds (e.g. 189 ms). After the duration, on the same line, is the set of pitch marks for that phonetic symbol and the percentage into the duration of that symbol where the specified pitch target should be reached. For example, on the line for 'AA', the pitch should be at 169 Hz at 9.45 ms into the duration for 'AA' (5% of 189 ms), while at the very end of 'AA' (100% of 189 ms), the pitch should be at 132 Hz.

Note that the above default intonation pattern is the best that the default rules known in the art can do, lacking knowledge of the semantics and context of the utterance (a greeting in this example). Unfortunately, the output from these default rules may sound flat or otherwise unappealing to a user. Therefore, the user may wish to change the prosody to reflect some emotion or involvement in the situation. With the present invention, the user only has to record him/herself (or use some previous recording) saying "Hi, Bob" with the appropriate intonation pattern, to reflect whatever emotion is desired.

The recorded speech is fed to a pitch tracker. Note that this technology is a standard speech processing component, and is well known in the art. It is a function of pitch trackers to distinguish between voiced and unvoiced sections of 'voicing' or speech. If a section of voicing is 'voiced' (as opposed to 'unvoiced'), it means that the speaker's vocal folds were periodically cycling between closed and open, in a semi-predictable or determinable manner. Of course, improved pitch trackers capable of discerning patterns in the noise portions of voicing or speech traditionally considered unvoiced could likewise be used with the approach of the present invention. Probably the most important such type distinction within an unvoiced or noise section of speech would be to identify silence versus frication noise.

After the pitch and duration of the utterance have been analyzed by the pitch tracker, the pitch tracker's output is input to an alignment routine. The alignment routine will see the pitch tracker's output in sections, each corresponding to a voicing period in the recorded speech.

In the example utterance ("Hi, Bob"), as can be seen in Table 1, the pitch tracker found 3 sections: Section #1 is voiced; Section #2 is unvoiced; and Section #3 is voiced again. The pitch tracker's output looks as follows for the sample utterance shown in the table. The first line indicates the total section duration, e.g. 263 ms for Section 1. Following that, every data line starts with the frequency (vocal fold vibration cycles per second) for a given sample of the utterance, e.g. 222 Hz on the first line. Following that is the duration of the pitch cycle (often referred to as 'pitch period' in the art of the present technology) in ms (5 ms for the first entry). Following that is the cumulative duration in ms for the entire section. The last number is the sample number of that portion of the recorded utterance. Note that for brevity and clarity, a number of lines in the middle of each section have not been shown. Further, note that, in the preferred embodiment of the present invention, there are entries in the unvoiced section (Section #2). The pitch tracker does not measure these (it can't because there were no vocal fold vibrations to measure). In the preferred embodiment of the present invention, these numbers are supplied as an initial step by the alignment routine, interpolating linearly between the last measurement of the preceding voiced period, and the first measurement of the following period.

TABLE 1

| Section #1 (Voiced) | Section #2 (Unvoiced) | Section #3 (Voiced) |
|---|---|---|
| duration = 263 ms | duration = 140 ms | duration = 416 ms |
| 222 5 5 10423 | 100 6 6 0 | 88 11 11 19546 |
| 222 5 10 10523 | 99 6 12 0 | 88 11 22 19798 |
| 220 5 15 10623 | 98 6 18 0 | 89 11 33 20050 |
| 222 5 20 10724 | 97 6 24 0 | 89 11 44 20300 |
| 220 5 25 10824 | 96 6 30 0 | . . . |
| 220 5 30 10925 | . . . | 172 6 392 28149 |
| . . . | 89 6 72 0 | 173 6 398 28278 |
| 116 9 214 14835 | 88 6 78 0 | 169 6 404 28406 |
| 110 9 223 15026 | | 176 6 410 28537 |
| 105 10 233 15227 | | 179 6 416 28663 |
| 100 10 243 15438 | | |
| 96 10 253 15659 | | |
| 100 10 263 15890 | | |

As stated previously, each phonetic symbol has an initial voicing specification (see Appendix A). Accordingly, the original, default specifications for the phonetic symbols in the example utterance "Hi, Bob." are:

h: unvoiced

AY: voiced b: unvoiced

AA: voiced b: unvoiced

Any segment labeled 'voiced' is expected to be included in a voiced period of speech, that is, a stretch of speech for which the pitch tracker can produce output from the natural utterance input. Any segment labeled 'unvoiced' is expected to cause a break in pitch tracker output. The alignment routine of the present invention first checks whether, using the default voicing assignments for the segments in the utterance (as shown), the number of voicing periods from the pitch tracker output match the number of voicing periods of the phonetic symbol transcription. In the example above, such a match is possible, as follows:

Alignment Voicing Segment 1:
no pitch tracker output, corresponds to UNVOICED 'h'
Alignment Voicing Segment 2:
pitch section #1, corresponds to VOICED 'AY'
Alignment Voicing Segment 3:
pitch section #2, corresponds to UNVOICED 'b'
Alignment Voicing Segment 4:
pitch section #3, corresponds to VOICED 'AA'
Alignment Voicing Segment 5:
no pitch tracker output, corresponds to UNVOICED 'b'

In this case then, with perfect matching, the alignment job of the present invention is now a relatively simple matter. For duration value determination purposes, for each alignment segment (voicing period) first compute the percentage of each phonetic symbol to the total of all phonetic symbols within that alignment segment (in this case, since there is only one symbol per alignment segment, it's 100%). Then, for each pitch section, take its total duration and assign each symbol within that pitch section its allotted percentage of that total duration, thus replacing the default duration values shown in the initial synthesized utterance.

In the system of the present invention, the measured pitch points (the reduction of an input wave form down to a sampled frequency over a given duration) are sampled by the pitch tracker at a certain granularity (typically 4 pitch points are applied per phonetic symbol in the preferred embodiment, whereas 3 is a minimum to indicate any inflection changes). For pitch determination purposes, for each pitch section, the pitch points read off the pitch tracker output from the natural utterance input are then applied to the synthesized utterance, replacing the pitch values that were applied by the synthesizer's default rules.

The resulting pitch and duration values for the given example utterance are in the expected format, for playout by the synthesis system, as can be seen below (based on a given natural utterance):

| | | | | | |
|---|---|---|---|---|---|
| Sent | 06 | | | | |
| Word | 02 | | | | |
| h | [90] | p120:50 | | | |
| AY | [263] | p222:5 | p216:30 | p195:55 | p136:80 |
| Word | 33 | | | | |
| b | [140] | p120:50 | | | |
| AA | [274] | p88:5 | p87:30 | p85:55 | p101:80 |
| b- | [143] | p119:5 | p136:30 | p151:55 | p172:80 |
| % | [1] | | | | |

Thus, in the preferred embodiment of the present invention, the synthesizer does not need to distinguish between inputs generated in the above fashion and the ordinary inputs coming from the default rules in the initial system processing.

Note that the example above is very simple, in two ways: 1) the voicing defaults listed for the phonetic symbols perfectly matched their behavior in the natural utterance; and 2) there was only one phonetic symbol in each voiced or unvoiced alignment segment. However, oftentimes a phonetic symbol that is expected, based on phonetic theory, to have a particular voicing quality (voiced or unvoiced) will, in a given example of actual speech, have the opposite quality. For example, in the given utterance, it would not be particularly unusual to see voicing throughout the first 'b' in 'Bob'. This would then collapse sections #1, #2 and #3 in the pitch tracker's output into a single, albeit longer, section. For these kinds of cases (where there is no initial match of alignment segments to pitch sections), in the preferred embodiment of the present invention, every permutation of the voicing values for certain variable phonetic symbols (again, see Appendix A) is attempted, to get the best match. E.g. the permutations listed below are possible for the given example utterance 'Hi Bob' which has already been translated to 'h.AY.b.AA.b' (note that the first permutation is the default specification for the example utterance):

| | | | | |
|---|---|---|---|---|
| 1. h:unvoiced | AY:voiced | b:unvoiced | AA:voiced | b:unvoiced |
| 2. h:unvoiced | AY:voiced | b:voiced | AA:voiced | b:unvoiced |
| 3. h:unvoiced | AY:voiced | b:unvoiced | AA:voiced | b:voiced |
| 4. h:unvoiced | AY:voiced | b:voiced | AA:voiced | b:voiced |

Note that, in general, there can be $2^n$ permutations of labeling with respect to the binary feature voice, where n is the number of variable phonetic symbols in a given transcription. Some symbols, particularly vowels such as 'AA' and certain stable consonants such as 'h' and 's', are never allowed to vary (again, see Appendix A for examples of these).

The system of the present invention will try every permutation of voicing specifications that will yield the same number of voiced periods for the phonetic transcription as are present in the pitch tracker output. Note that for a long utterance, there may be one hundred or more matching permutations. As stated previously, the present invention thus includes a metric for selecting the best permutation for alignment and intonation specification of a given utterance. This metric minimizes the following factors, in priority of their order:

1. the accumulated error, in percentage, of the duration of each section in the pitch tracker's output as compared to the default-specified duration of the corresponding transcription segment;
2. the number of phonetic symbols for which the default voicing specification (e.g. 'unvoiced' for 'b') had to be switched (from voiced to unvoiced, or vice-versa) in order to match the number of alignment portions to pitch sections;
3. the number of pitch tracker voicing sections which were under 40%, or over 150%, of the default-specified duration for the corresponding phonetic transcription segment.

As an example of the use of the metric that compares the alignments resulting from different voicing specifications (voiced or unvoiced) on those segments with flexible or permutable voicing specifications, consider the following phonetic transcription for the utterance:

"That's a great idea."

For this example, each line below starts with a phonetic symbol, followed by a duration specification, followed by one or more pitch specifications. This part of the formatting is the standard synthesizer phonetic symbol output file, which has been described in detail above (note: for brevity and clarity, the Sent, Word and summation lines have been omitted in this example.).

| | | | | |
|---|---|---|---|---|
| D | [71] | p72:0 | | {0}v |
| AE | [124] | p77:100 | | {0}v |
| t- | [90] | p55:50 | | {1}u |
| s | [104] | p61:50 | | {1}u |
| ?AX | [75] | p61:30 | p61:100 | {2}v |
| g | [95] | p67:50 | | {3}u |

-continued

| | | | | |
|---|---|---|---|---|
| r | \|30\| | p73:50 | | {4}v |
| EY | \|145\| | p80:30 | p75:100 | {4}v |
| t- | \|94\| | p69:50 | | {5}u |
| ?AY | \|180\| | p59:50 | | {6}v |
| d | \|92\| | p67:50 | | {7}u |
| IY | \|135\| | p75:5 | | {8}v |
| ?AX | \|125\| | p32:100 | | {8}v |

In addition, each line in this example has been marked at its end with a special notation, of the form {n}v or {n}u. This is a "hand annotation" introduced for this example, and is not evident in the file as used by the approach of the present invention. These notations show the actual, true voicing status ('v' for voiced, 'u' for unvoiced) of each speech segment (denoted 'n') from a natural, recorded utterance that corresponds to this abstract phonetic symbol file (as opposed to the default voicing specifications). The value of this "hand annotation" is that it provides a standard of reference for this example. Such annotation is not required for operation of the automatic approach of the present invention and is only used for illustrative purposes here.

A trained human operator could examine each sound in the natural recorded utterance and make an expert judgement as to whether the sound was voiced or not. In this way, a trained human operator could try match the voicing sections present in the pitch tracker's output to the phonetic symbols from the default settings. In other words, a trained human operator could, for purposes of this example, act as a 'perfect aligner', doing for a single utterance what the present invention does automatically.

Note that the actual pitch tracker output file is omitted from this example for purposes of brevity and clarity. An example of a pitch tracker output file is given elsewhere in this document. In effect, the voicing segment section affiliation number ({n}) specified for each phonetic symbol in the list above will serve to indicate the pitch tracker's conclusions about the file, for this example (in other words, the voicing indication serves two roles in this example, as the voicing specification for the associated phonetic symbol, whether flipped or not, and as the result of the pitch tracker analysis of the recorded natural utterance).

In the current example, we see that the phonetic symbol 'D' (the first symbol), which has had its voicing flipped from the default unvoiced (see Appendix A) to voiced in order to achieve the proper number of alignment segments, aligns with pitch tracker output section 0, which likewise is voiced. The next symbol, 'AE', was also found to be voiced (in accordance with the default voicing specification and as one expects a vowel to be), and is therefore grouped with 'D' in voicing section 0 of the pitch tracker output. The third phonetic symbol, t-, was found on inspection to be unvoiced (according to the default voicing specifications by adhering, again in this case, to the predictions of phonetic theory), and thus belongs to a new pitch tracker section, an unvoiced one (pitch tracker output sections strictly alternate in voicing type—two adjacent voiced sections would always be represented as a single, merged section). This process would thus continue until all phonetic symbols and pitch tracker output sections were matched or aligned.

Note that, based on the hand annotations included in the phonetic symbol list, the approach of the present invention could merely 'force' an alignment, once the proper number of sections/segments were found. This can be used to represent the ideal case wherein the listing below shows the results of such 'forced' or hand (human operator) alignment. There are 9 voicing sections (i.e. sections of pitch tracker output, whether voiced or unvoiced). In this example, the 'cumulative error' in the matching between the hand-annotated phonetic symbol file and the pitch tracker output can be calculated to be 292%. What this cumulative error means is that when the total duration for all of the symbol file sections was compared with the total duration of all of the voicing sections provided by the pitch tracker, the total percentage difference was 292%.

Therefore, even when using a file annotated by a so-called perfect human aligner, the matches will generally always have some cumulative error. This is the natural result of the fact that the duration values in the synthesizer are assigned by default rules that do not exactly model any particular real speaker. However, in reality this alignment generated by hand-annotated input is reasonable, and generally sounds quite accurate. Some figures describing the hand alignment are given below. Note that all of the elements of the metric used in the present invention are shown below: the cumulative error metric; the count of 'bad' matches or pairings where one member of a match is far bigger or smaller than the other member (>150% or <40%); and the number of changes that had to be made to the default voicing specifications to achieve the match specified in the hand-annotated input file.

HAND OPERATOR ALIGNMENT:

Sections=9

Cumulative error metric=292%

Matches where a section is 150% or more=0

Matches where a section is 40% or less=0

Voicing changes from default specifications=1

Section #0: Input section is 76% of input pitch section.

Section #1: Input section is 110% of input pitch section.

Section #2: Input section is 67% of input pitch section.

Section #3: Input section is 47% of input pitch section.

Section #4: Input section is 45% of input pitch section.

Section #5: Input section is 43% of input pitch section.

Section #6: Input section is 82% of input pitch section.

Section #7: Input section is 102% of input pitch section.

Section #8: Input section is 60% of input pitch section.

Of course, in real operation, the system does not have hand-annotations available for each input utterance telling it whether each symbol should really be voiced or unvoiced, and which voicing section in the pitch tracker output to affiliate with. Therefore, the system has to try alternatives and make an informed determination.

Below is an example of the actual alignment the present invention produces when not guided by hand annotations (which, again, have only been provided herein for exemplification, and are not available in real system operation). We see that, just as in the human operator 'perfect alignment' case discussed above, there are 9 voicing sections. This is the basic prerequisite for further consideration of a candidate alignment: that the number of voicing sections in the candidate alignment be equal to the number of voicing sections reported by the pitch tracker when it analyzed the natural, recorded utterance corresponding to the phonetic symbol file. If, out of all the possible partitionings of the phonetic symbol file that result from flipping the voicing specifications of the individual phonetic symbols, only one had exactly 9 voicing sections, only that alignment would be taken. However, in general, often more than one possible alignment will meet the prerequisite condition, in this case, to have exactly 9 voicing sections.

Below we see the top alignment picked by the approach of the present invention from among several dozen candidate alignments (all with exactly 9 voicing sections) that could have been chosen. First of all, the number of sections is the same as the pitch tracker output (9, as has been explained). In addition, the cumulative error of 251% is actually less than the theoretical best given above. While this may seem confusing, remember that every possible 9-section candidate was considered during the automatic operation of the system. This means that an alignment identical to the human operator alignment listed above was actually considered by the approach of the present invention. However, the alignment chosen by the human operator was rejected by the metric of the present invention.

SYSTEM ALIGNMENT:

Sections=9

Cumulative error metric=251%

Matches where a section is 150% or more greater=0

Matches where a section is 40% or less smaller=0

Voicing changes from default labels=1

Section #0: Input section is 76% of input pitch section.
Section #1: Input section is 110% of input pitch section.
Section #2: Input section is 94% of input pitch section.
Section #3: Input section is 47% of input pitch section.
Section #4: Input section is 45% of input pitch section.
Section #5: Input section is 43% of input pitch section.
Section #6: Input section is 96% of input pitch section.
Section #7: Input section is 102% of input pitch section.
Section #8: Input section is 100% of input pitch section.

The present approach metric places primary importance on the cumulative error, above the other factors. In this example, the present approach was able to find another 9-section alignment that had a lower cumulative error thus becoming the better candidate. Remember that the cumulative error depends on the duration values given by the output of the synthesizer default duration rules, which are not necessarily totally 'natural'. It must be kept in mind that it is likely that other alternative alignments, also with cumulative error greater than 251%, and some with cumulative error greater than 292% were also rejected.

If there had been another alignment candidate with 251% cumulative error, but that required more phonetic symbols to take on a voicing specification that differed from the default specification, that other alignment candidate would have been rejected, because an alignment candidate that required fewer phonetic symbols to flip voiced specifications was available. Thus, the approach of the present invention is to place secondary importance on the number of flipped voicing specifications.

Further, note that the percentage error in individual sections, between the chosen alignment and the hand alignment, agrees in voicing sections #0, 1, 3, 4, 5, and 7 and disagrees in voicing sections #2, 6, and 8. In actuality, this is a very good result because the mis-aligned areas do not differ by a tremendous percentage, and in fact the misalignment will not likely be perceptually detectable by average listeners on playback.

Note that there were no sections which were under 40% of the default specified duration. In the preferred embodiment of the present invention, this is the final factor in determining which alignment candidate will be chosen. If there had been two alignment candidates with equally low cumulative errors and with equal numbers of default voicing flips, then the alignment candidate with the fewest voicing sections under 40% and over 150% would be selected.

But suppose that no alignment candidate had been found that had exactly 9 sections, no matter what voicing values were placed on any phonetic symbol (among those that are allowed to vary voicing values from the default on the input list—see Appendix A). In this case, the approach of the present invention does not attempt such a detailed alignment. Instead, the approach of the present invention falls back on a simple fact: the beginning of the pitch tracker output can be aligned with the first phonetic symbol, and the end of the pitch tracker output can be aligned with the last phonetic symbol (in the case of utterance-initial or utterance-final voiceless segments, this isn't strictly true, but it makes little perceptual difference on playback). Therefore, the entire pitch tracker output can be viewed in such cases as 'one big voicing section'. Correspondingly, the entire phonetic symbol file can be viewed as a single, corresponding 'one big voicing section'.

Viewed this way, the system can apply to the entire file exactly the same processing that it applies to a single voicing section (0 through 9 in the example above). That is, the system can start at the beginning of the pitch tracker output, and start reading pitch numbers from the pitch tracker output and applying them to phonetic symbols. The duration values used for the system output in this case are again calculated for the entire file in exactly the same way they are calculated for separate elements in a single voicing section in the more sophisticated processing of the examples above: the total duration of the pitch tracker output is calculated, and each segment gets the same percentage of that total value that it had of the synthesized utterance total duration value (summed across the whole phonetic symbol file).

Here is a simplified example of how the 'whole utterance' backup processing works in the present invention when the detailed alignment stage has failed. Suppose that the utterance was:

"A cat sat on the pad."

The simplified phonetic symbol file (duration values are fake, pitch values are omitted) would look like:

| | |
|---|---|
| AX | [100] |
| k | [100] |
| AE | [100] |
| t | [100] |
| s | [100] |
| AE | [100] |
| t | [100] |
| AX | [100] |
| n | [100] |
| D | [100] |
| AX | [100] |
| p | [100] |
| AE | [100] |
| d | [100] |

Now suppose that when the user uttered this sentence with his/her desired prosody, some quality of his/her voice confused the pitch tracker and cause it to produce sections that did not align with any permutation of the phonetic symbol file, no matter how the voicing specifications were changed. Note that this can happen when the user's voice is particularly rough, due to sickness or congenital condition. This can also happen when the user has a strong dialectal pronunciation of certain items that does not match well with the default standard dialect on which the synthesizer's phonetic symbol inventory is based.

In any case, suppose no alignment is possible. Then the whole phonetic symbol file will be viewed as a single section for alignment purposes. The duration of this 'section' is the sum of all its segments' durations, i.e. 1400 ms. Then a percentage of this total is calculated and stored, for each segment. In this simplified example, the initial segment 'AX' happens to be approximately 7% of the total (100 ms/1400 ms; note: because the example is simplified, the others are the same as well). Now suppose that the total duration of the spoken utterance, represented by the pitch tracker file of 'voicing sections' is 1800 ms. Then each phonetic symbol from the phonetic symbol transcription will use its percentage of the transcription duration to determine the actual ms duration value over the modified utterance. In this case, the symbol 'AX' will get a duration of about 126 ms (7% of 1800 ms). The duration values for the remaining segments will be similarly calculated. Note that this duration calculation based on percentage of total is identical to that used for the duration determinations based on voicing section match-up, as described above. It's just that in this case, the whole utterance is taken as a single voicing section.

The way this would look in the alignment presentation format used in the earlier example would be:

SYSTEM ALIGNMENT:

Sections=1

Cumulative error metric=91%

Matches where one section is 150% or more greater=0

Matches where one section is 40% or less smaller=0

Voicing changes from default labels=0

Section #0: Input section is 91% of input pitch section.

It can be seen that the system has concluded that there is just 'one long voicing section'. In every other way, again, this case is handled just like the more detailed alignment cases described above.

Further, because 'unvoiced' elements are subsumed by the total-utterance voicing section in this approach, the interpolated pitch numbers in the pitch tracker output (described above) are useful: the approach of the present invention can stream right across the interpolated pitch tracker output as though it truly contained only one long, completely voiced section. Of course, some synthesizers do not allow application of pitch period information onto non-periodic phonetic symbols (e.g. "S") and would thus simply ignore this information at synthesis time.

Note that the approach of the present invention works particularly well under very resource constrained conditions (e.g. when only the pitch tracker output is available without access to the recorded natural utterance—hence the recorded natural utterance need not be maintained with the approach of the present invention). Further, because the text-to-phonetics operation is independent of the pitch tracker operation, these functions could operate either sequentially or in parallel depending upon the available processing resources. Still further, under more generous assumptions, and with better speech recognition under development, note that the approach of the present invention could utilize a speech recognizer's output.

For further intonation modification, referring again to FIG. 2, the present invention also incorporates a new kind of graphical prosody editor 207. The system of the present invention uses a graphical window display, indicating the sequence of phonetic symbols, and the duration and pitch change points of each symbol. In the preferred embodiment of the present invention, the graphical representations of each symbol's intonational properties can be altered using mouse control. A sample intonation editor window for synthesized speech is shown in FIG. 3.

Figure 3:
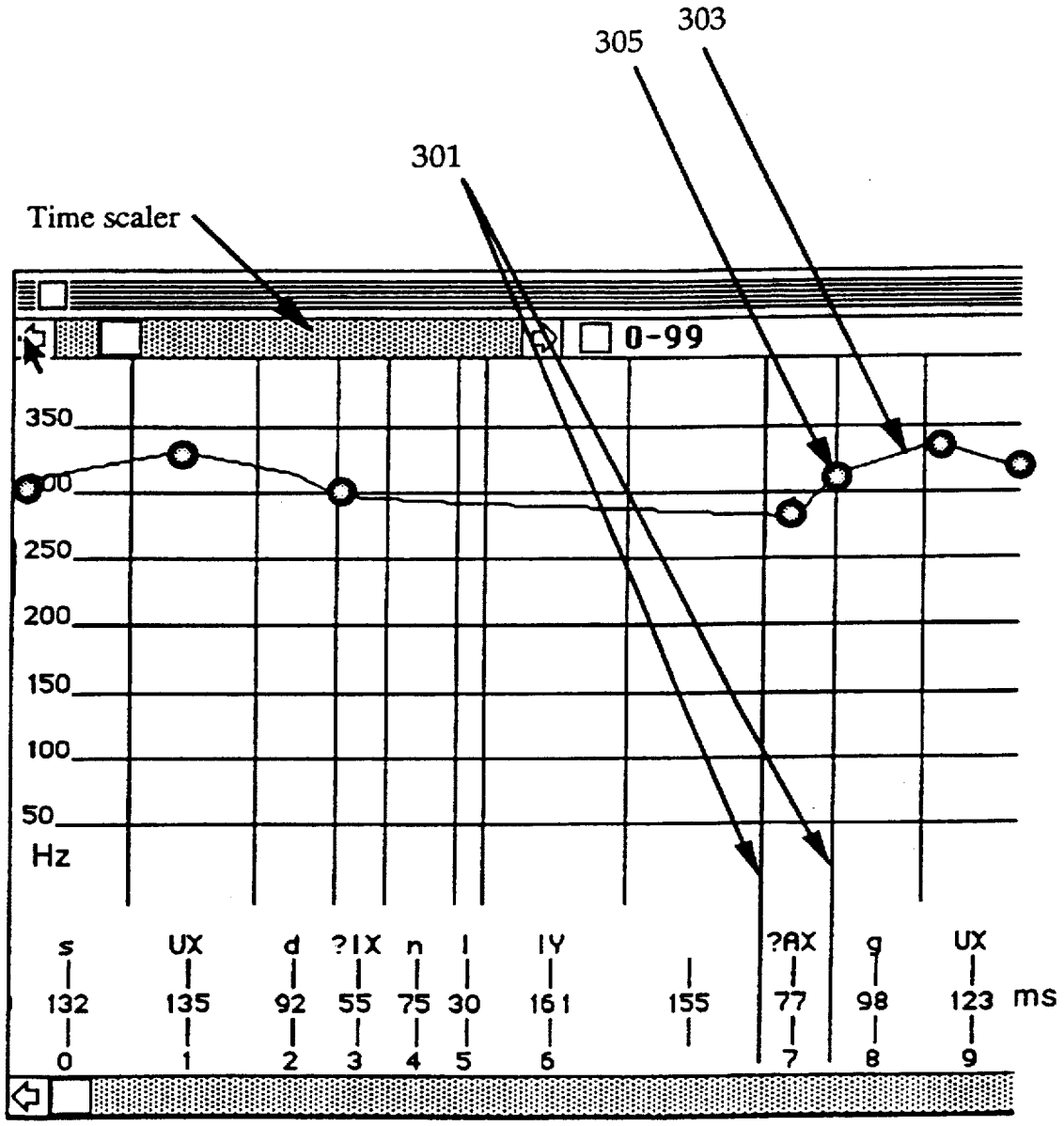
FIG. 3 is an example of the direct manipulation computer user interface of the present invention.

FIG. 3 shows a display that might be produced for the first few sounds of a sentence beginning as follows "Suddenly a gust of . . . ". The phonetic symbols are displayed in the bottom part of the display. Each symbol has its sequence number (starting with 0), and its duration in ms (based on default values or as determined from the natural utterance's intonation by the approach described above) displayed. The orthography could also be included on this line (e.g. 'suddenly' would be the orthography for 's.UX.d.?IX.n.l.IY'). Above the symbol line, a pitch grid is displayed, with numeric frequency values marked on the left side, from 50 to 350 Hz in the preferred embodiment (other scales could also be used, such as a logarithmic scale).

The window is divided by vertical lines 301 that indicate phonetic symbol extent boundaries. The vertical boundaries are user-selectable (via a handheld device, such as a mouse, in the preferred embodiment of the present invention) and moveable (a signal, e.g. an option key, can be provided to distinguish whether the phonetic symbol to the left or right of the vertical boundary mark is to have its duration modified by movement of the vertical extent line). The generally horizontal zig-zag line 303 across the main portion of the window indicates the pitch level of the utterance at any point in time. Handles 305 (as indicated by the solid circles) are provided at pitch change points in the contour. The handles are also user-selectable, and can be moved up or down, right or left. In the preferred embodiment of the present invention, pitch is interpolated linearly between change points in the contour. Of course, any arbitrary interpolation function (e.g. concave or convex to some degree) could likewise be applied. In the preferred embodiment of the present invention, new points can be added to the existing contour by the user selecting the line between existing points. Separate controls are provided for playback of the modified synthetic utterance. This improved interface thus gives the user a convenient method for refinement and testing of the prosody of a given utterance.

Figures 4, 4A:
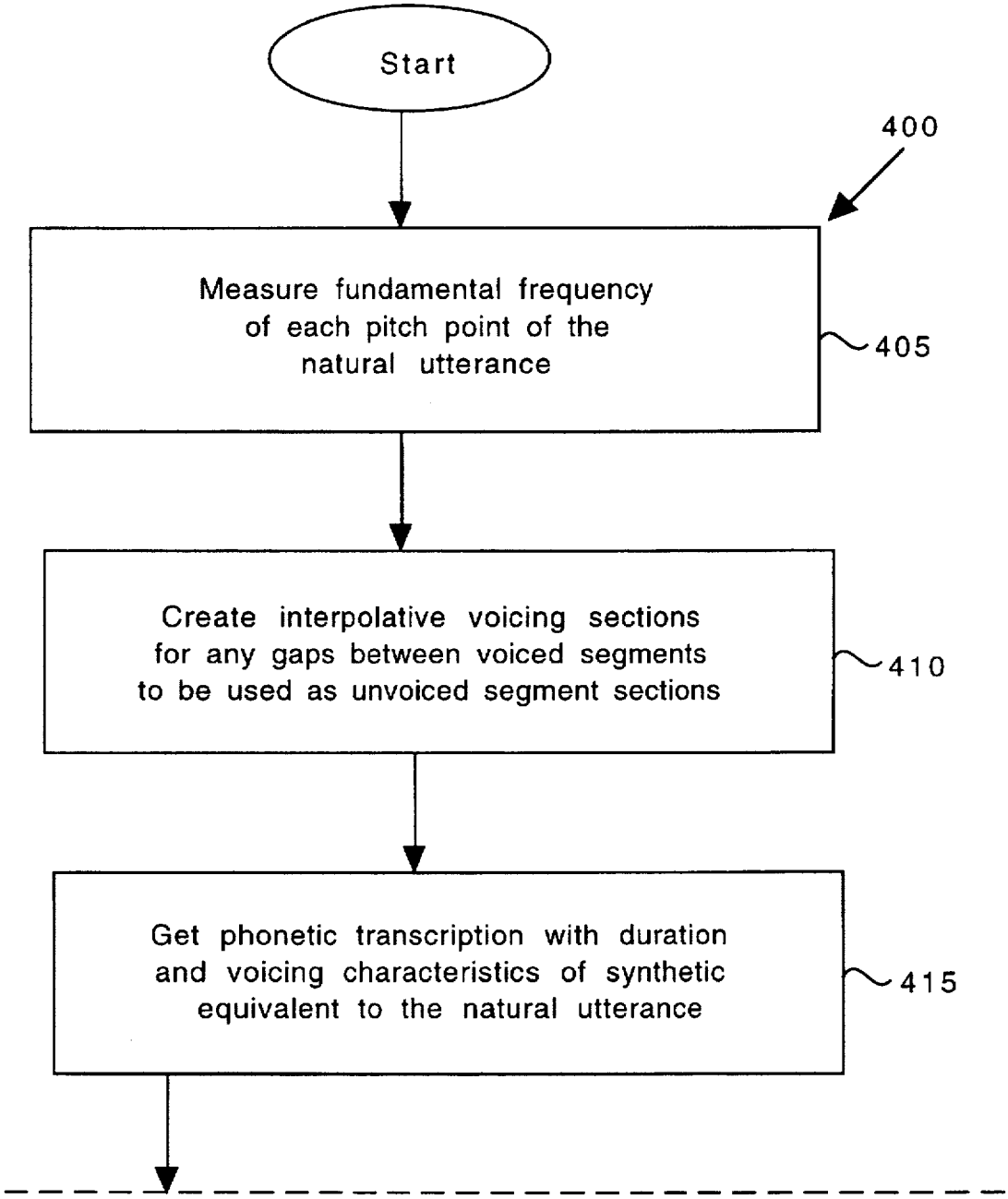
FIG. 4 is a flowchart illustrating a method for specifying speech intonation values.
Figure 4B:
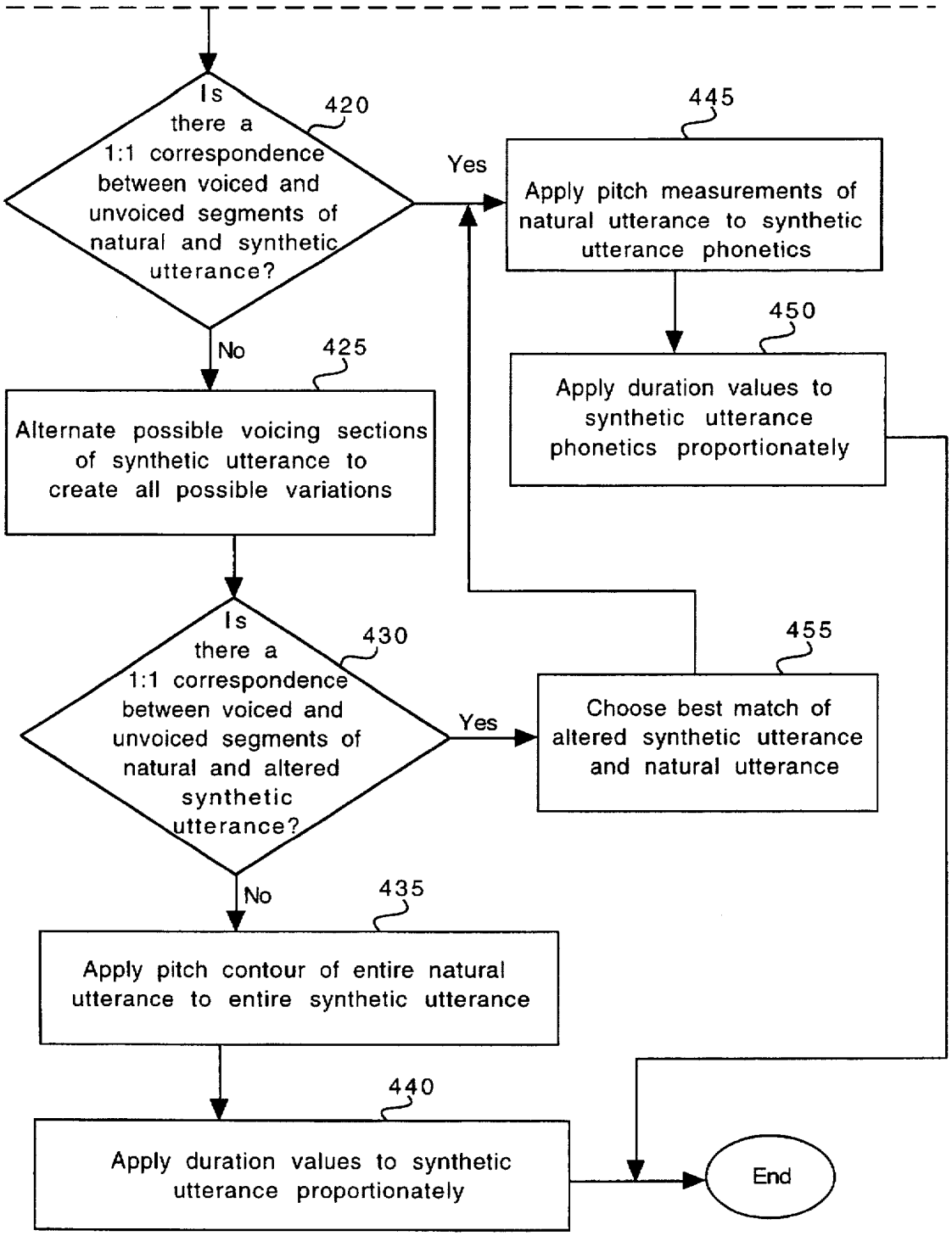

FIG. 4 is a flowchart illustrating a method 400 for specifying speech intonation values. Method 400 begins in step 405 by measuring the fundamental frequency of each pitch point of the natural utterance. In step 410, interpolative voicing sections are created for any gaps between voiced segments to be used as unvoiced segment sections. In step 415, the phonetic transcription with duration and voicing characteristics of the synthetic equivalent to the natural utterance are obtained.

Step 420 determines whether there is a one-to-one correspondence between the voiced and unvoiced segments of the natural and synthetic utterances. If so, then in step 445 the pitch measurements of the natural utterance are applied to the synthetic utterance phonetics, and in step 450 the duration values are proportionally applied to the synthetic utterance phonetics. Method 400 then ends. If in step 420 there is not a one-to-one correspondence, then in step 425 alternative possible voicing sections of the synthetic utterance are computed to create all possible permutations.

Step 430 determines whether there is a one-to-one correspondence between the voiced and unvoiced segments of the natural utterance and the alternative synthetic utterances. If so, then the best matching synthetic utterance alternative is chosen, and method 400 returns to step 445. If not, then step 435 applies the pitch contour of the entire natural utterance to the entire synthetic utterance, and in step 440 the duration values of the natural utterance are proportionally applied to the synthetic utterance. Method 400 then ends.

The present invention has been described above by way of example, but it should be clear that this is intended to be merely illustrative and not as defining the scope of the invention. Such modifications and variations of the embodiments of the present invention described above, that may be apparent to a person skilled in the art, are intended to be included within the scope of this invention.

APPENDIX A

This appendix shows the default voicing status of every phonetic symbol in the given language. Initially, a phonetic symbol may be voiced or unvoiced, based on a combination of phonetic theory and actual observations of the behavior in pitch tracks of the phonetic symbol in question. Furthermore, some phonetic symbols have flexible voicing specifications, that is, during prosody processing, the specification can be 'flipped' to its opposite, to see whether the flipped specification could yield a better alignment with the actual behavior of the phonetic symbol in the spoken utterance.

Other information given for each phonetic symbol is the 'level' at which the 'flipping' may occur. The available levels are (based upon likelihood of needing to be flipped in order to obtain a match):

Level 1: b, b-, d, d-, g, g-

Level 2: v, f, T, D, C, J, p, p-, t, t-, k, k-

Level 3: p', p", t', t", k', k"

Level 4: s, S, all vowels, all sonorants (nasals, glides, liquids)

The advantage of levels is that if we can get a good match by considering only permutations of 'flipped' voicing specifications for segments in the utterance at a lower level, there is no need to proceed to the next higher level. This thus saves processing time and, further, only affects those phonetic symbols most likely to need flipping in order to obtain a match. Note that this processing is optional. In one embodiment of the present invention, levels 1, 2 and 3 are all merged, and considered equal while symbols at level 4 never have their voicing specification flipped. Note that 'noglottal' means the segment does not begin with a glottalized quality while 'glottal' means the segment does begin with a glottalized quality.

The 'real' (or 'virtual') tag is used in the preferred embodiment of the present invention to distinguish the [?] (glottal stop) phonetic symbol, which is not used in the synthesizer, but is used in prosody processing as a 'virtual' or false phonetic symbol to help alignment with the pitch tracker output. All other phonetic symbols are 'real' in the sense that they are phonetic symbols recognized by the synthesizer. The fields for each single line phonetic symbol are:

phonetic symbol default voicing level at which voicing default can be flipped vowel?

glottal onset?

real phonetic symbol for output, or internal use only?

| | | | | | | |
|---|---|---|---|---|---|---|
| % | (Silence) | voiced | 4 | yesvowel | noglottal | real |
| @ | (Breath) | voiced | 4 | yesvowel | noglottal | real |
| IY | (beet) | voiced | 4 | yesvowel | noglottal | real |
| ?IY | (eat) | voiced | 4 | yesvowel | glottal | real |
| IR | (beard) | voiced | 4 | yesvowel | noglottal | real |
| ?IR | (ear) | voiced | 4 | yesvowel | glottal | real |
| IH | (bit) | voiced | 4 | yesvowel | noglottal | real |
| ?IH | (ill) | voiced | 4 | yesvowel | glottal | real |
| IX | (roses) | voiced | 4 | yesvowel | noglottal | real |
| ?IX | (illiterate) | voiced | 4 | yesvowel | glottal | real |

-continued

| | | | | | | |
|---|---|---|---|---|---|---|
| EY | (bait) | voiced | 4 | yesvowel | noglottal | real |
| ?EY | (aim) | voiced | 4 | yesvowel | glottal | real |
| ER | (bird) | voiced | 4 | yesvowel | noglottal | real |
| ?ER | (ermine) | voiced | 4 | yesvowel | glottal | real |
| EH | (bet) | voiced | 4 | yesvowel | noglottal | real |
| ?EH | (estimate) | voiced | 4 | yesvowel | glottal | real |
| AA | (father) | voiced | 4 | yesvowel | noglottal | real |
| ?AA | (otter) | voiced | 4 | yesvowel | glottal | real |
| AR | (bard) | voiced | 4 | yesvowel | noglottal | real |
| ?AR | (art) | voiced | 4 | yesvowel | glottal | real |
| AE | (bat) | voiced | 4 | yesvowel | noglottal | real |
| ?AE | (after) | voiced | 4 | yesvowel | glottal | real |
| AX | (sofa) | voiced | 4 | yesvowel | noglottal | real |
| ?AX | (about) | voiced | 4 | yesvowel | glottal | real |
| UW | (boot) | voiced | 4 | yesvowel | noglottal | real |
| ?UW | (oops) | voiced | 4 | yesvowel | glottal | real |
| UR | (lured) | voiced | 4 | yesvowel | noglottal | real |
| ?UR | (Urdu) | voiced | 4 | yesvowel | glottal | real |
| UH | (book) | voiced | 4 | yesvowel | noglottal | real |
| ?UH | (Uppsala) | voiced | 4 | yesvowel | glottal | real |
| UX | (bud) | voiced | 4 | yesvowel | noglottal | real |
| ?UX | (ugly) | voiced | 4 | yesvowel | glottal | real |
| OW | (boat) | voiced | 4 | yesvowel | noglottal | real |
| ?OW | (over) | voiced | 4 | yesvowel | glottal | real |
| OR | (board) | vdiced | 4 | yesvowel | noglottal | real |
| ?OR | (oar) | voiced | 4 | yesvowel | glottal | real |
| AO | (water) | voiced | 4 | yesvowel | noglottal | real |
| ?AO | (auspices) | voiced | 4 | yesvowel | glottal | real |
| AY | (bite) | voiced | 4 | yesvowel | noglottal | real |
| ?AY | (ice) | voiced | 4 | yesvowel | glottal | real |
| AW | (bout) | voiced | 4 | yesvowel | noglottal | real |
| ?AW | (out) | voiced | 4 | yesvowel | glottal | real |
| OY | (boy) | voiced | 4 | yesvowel | noglottal | real |
| ?OY | (oil) | voiced | 4 | yesvowel | glottal | real |
| p | (spar) | unvoiced | 2 | novowel | noglottal | real |
| p- | (upturn) | unvoiced | 2 | novowel | noglottal | real |
| p" | (pea) | unvoiced | 3 | novowel | noglottal | real |
| p' | (gap) | unvoiced | 3 | novowel | noglottal | real |
| t | (star) | unvoiced | 2 | novowel | noglottal | real |
| t- | (bitmap) | unvoiced | 2 | novowel | noglottal | real |
| t" | (tea) | unvoiced | 3 | novowel | noglottal | real |
| t' | (mat) | unvoiced | 3 | novowel | noglottal | real |
| k | (scar) | unvoiced | 2 | novowel | noglottal | real |
| k- | (sickbed) | unvoiced | 2 | novowel | noglottal | real |
| k" | (key) | unvoiced | 3 | novowel | noglottal | real |
| k' | (hack) | unvoiced | 3 | novowel | noglottal | real |
| b | (bet) | unvoiced | 1 | novowel | noglottal | real |
| b- | (obdurate) | unvoiced | 1 | novowel | noglottal | real |
| d | (dot) | unvoiced | 1 | novowel | noglottal | real |
| d- | (madman) | unvoiced | 1 | novowel | noglottal | real |
| g | (get) | unvoiced | 1 | novowel | noglottal | real |
| g- | (pegboard) | unvoiced | 1 | novowel | noglottal | real |
| Q | (pity) | unvoiced | 1 | novowel | noglottal | real |
| f | (fee) | unvoiced | 2 | novowel | noglottal | real |
| T | (thaw) | unvoiced | 2 | novowel | noglottal | real |
| s | (see) | unvoiced | 4 | novowel | noglottal | real |
| S | (she) | unvoiced | 4 | novowel | noglottal | real |
| v | (vow) | unvoiced | 2 | novowel | noglottal | real |
| D | (bathe) | unvoiced | 2 | novowel | noglottal | real |
| z | (zip) | voiced | 2 | novowel | noglottal | real |
| Z | (genre) | unvoiced | 2 | novowel | noglottal | real |
| h | (hot) | unvoiced | 2 | novowel | noglottal | real |
| C | (chew) | unvoiced | 2 | novowel | noglottal | real |
| J | (jaw) | unvoiced | 2 | novowel | noglottal | real |
| m | (met) | voiced | 4 | novowel | noglottal | real |
| m# | (prism) | voiced | 4 | novowel | noglottal | real |
| n | (net) | voiced | 4 | novowel | noglottal | real |
| n# | (carton) | voiced | 4 | novowel | noglottal | real |
| N | (sing) | voiced | 4 | novowel | noglottal | real |
| r | (red) | voiced | 4 | novowel | noglottal | real |
| r= | (bear) | voiced | 4 | novowel | noglottal | real |
| l | (let, plead, hi=lly) | voiced | 4 | novowel | noglottal | real |
| l# | (apple) | voiced | 4 | novowel | noglottal | real |
| l= | (help, wholl=y) | voiced | 4 | novowel | noglottal | real |
| y | (yes) | voiced | 4 | novowel | noglottal | real |
| w | (wet) | voiced | 4 | novowel | noglottal | real |
| ? | (—) | unvoiced | 1 | novowel | noglottal | virtual |

What is claimed is:

1. A method for specifying synthetic speech intonation, comprising the steps of:

(a) obtaining natural pitch and duration values for a natural voicing section of a natural utterance;

(b) obtaining synthetic pitch and duration values for a synthetic voicing section of a synthetic equivalent to the natural utterance;

(c) aligning the natural voicing section to the synthetic voicing section; and (d) replacing the synthetic pitch and duration values of the synthetic voicing section with the natural pitch and duration values.

2. The method of claim 1 wherein step (a) comprises using a pitch tracker to take pitch measurements of the natural utterance over n pitch periods.

3. The method of claim 2 wherein step (a) further comprises interpolating pitch measurements between voiced portions of the natural voicing section.

4. The method of claim 1 wherein step (b) comprises retrieving predetermined phonetic duration and pitch values from a look-up table.

5. The method of claim 1 wherein step (c) comprises sequentially aligning alternating voiced and unvoiced types of the natural voicing section to alternating voiced and unvoiced types of the synthetic voicing section.

6. The method of claim 1 wherein step (c) comprises:

i) varying voicing possibilities for the synthetic voicing section until one or more alignments are reached between alternating voiced and unvoiced types of the synthetic voicing section and alternating voiced and unvoiced types of the natural voicing section; and ii) sequentially aligning the alternating voiced and unvoiced types of the natural voicing section to the alternating voiced and unvoiced types of the synthetic voicing section until a best reached alignment is achieved.

7. The method of claim 6 wherein the best reached alignment is the alignment with a:

i) lowest accumulated error between the natural voicing section and the synthetic voicing section;

ii) fewest variable voicing possibilities actually varied; and iii) fewest natural voicing sections which fall outside a predetermined duration range.

8. An apparatus for intonation specification comprising:

(a) means for obtaining natural pitch and duration values for a natural voicing section of a natural utterance;

(b) means for obtaining synthetic pitch and duration values for a synthetic voicing section of a synthetic equivalent to the natural utterance;

(c) means for aligning the natural voicing section to the synthetic voicing section; and (d) means for substituting the natural pitch and duration values of the natural voicing section for the synthetic pitch and duration values.

9. The apparatus of claim 8 wherein element (a) comprises a pitch tracker capable of taking pitch measurements of the natural utterance over n pitch periods.

10. The apparatus of claim 9 wherein element (a) further comprises means for interpolating pitch measurements between voiced portions of the natural voicing section.

11. The apparatus of claim 8 wherein element (b) comprises a look-up table of predetermined phonetic duration and pitch values.

12. The apparatus of claim 8 wherein element (c) comprises means for sequentially aligning alternating voiced and unvoiced types of the natural voicing section to alternating voiced and unvoiced types of the synthetic voicing section.

13. The method of claim 8 wherein step (c) comprises:

i) means for varying voicing possibilities for the synthetic voicing section until one or more alignments are reached between sequentially voiced and unvoiced types of the synthetic voicing section and alternating voiced and unvoiced types of the natural voicing section; and ii) means for sequentially aligning alternating voiced and unvoiced types of the natural voicing section to alternating voiced and unvoiced types of the synthetic voicing section until a best reached alignment is achieved.

14. The apparatus of claim 13 wherein the best reached alignment is the alignment with a:

i) lowest accumulated error between the natural voicing section and the synthetic voicing section;

ii) fewest variable voicing possibilities actually varied; and iii) fewest natural voicing sections which fall outside a predetermined duration range.

15. A method for intonation specification comprising the following steps:

a) obtaining natural voiced pitch and duration values for a natural voiced portion of a natural utterance;

b) obtaining natural unvoiced pitch and duration values for a natural unvoiced portion of the natural utterance;

c) obtaining synthetic voiced and unvoiced pitch and duration values for synthetic voiced and unvoiced portions of a synthetic equivalent to the natural utterance;

d) aligning the natural voiced and unvoiced portion to the synthetic voiced and unvoiced portions; and e) substituting the natural voiced and unvoiced pitch and duration values for the synthetic voiced and unvoiced pitch and duration values.

16. The method of claim 15 wherein step (a) comprises using a pitch tracker to take pitch measurements of the natural utterance over n pitch periods.

17. The method of claim 15 wherein the natural utterance includes multiple natural voiced portions, and step (b) comprises interpolating pitch measurements between the natural voiced portions.

18. The method of claim 15 wherein step (c) uses a look-up to a table of a set of predetermined phonetic duration and pitch values.

19. The method of claim 15 wherein step (d) comprises sequentially aligning alternating natural voiced and unvoiced portions to alternating synthetic voiced and unvoiced portions.

20. The method of claim 15 wherein step (d) comprises:

i) varying voicing possibilities of the synthetic voiced and unvoiced portions until one or more alignments are reached between the alternating synthetic voiced and unvoiced portions and the alternating natural voiced and unvoiced portions; and ii) sequentially aligning the alternating natural voiced and unvoiced portions to the alternating synthetic voiced and unvoiced portions until a best reached alignment is achieved.

21. The method of claim 20 wherein the best reached alignment is the alignment with a:

i) lowest accumulated error between the natural voiced and unvoiced portions and the synthetic voiced and unvoiced portions;

ii) fewest variable voicing possibilities actually varied;

iii) fewest natural voiced portions which fall outside a predetermined duration range.

22. A method for intonation specification in a synthetic speech system comprising the following steps:

a) obtaining a set of pitch and duration values of one or more voicing sections of a natural utterance;

b) obtaining a set of pitch and duration values of one or more voicing sections of a synthetic equivalent to the natural utterance;

c) aligning the one or more voicing sections of the natural utterance to the one or more voicing sections of the synthetic equivalent to the natural utterance, including the steps of i) varying voicing possibilities of the one or more voicing sections of the synthetic equivalent to the natural utterance until one or more alignments are reached between sequentially voiced and unvoiced types of the one or more voicing sections of the synthetic equivalent to the natural utterance and alternating voiced and unvoiced types of the one or more voicing sections of the natural utterance; and ii) sequentially aligning alternating voiced and unvoiced types of the one or more voicing sections of the natural utterance to alternating voiced and unvoiced types of the one or more voicing sections of the synthetic equivalent to the natural utterance for the best reached alignment between sequentially voiced and unvoiced types of the one or more voicing sections of the synthetic equivalent to the natural utterance and alternating voiced and unvoiced types of the one or more voicing sections of the natural utterance, the best reached alignment being the alignment with the i) lowest accumulated error between the one or more voicing sections of the natural utterance and the one or more voicing sections of the synthetic equivalent to the natural utterance;

ii) fewest voicing possibilities actually varied; and iii) fewest of the one or more voicing sections of the natural utterance which fell outside a predetermined duration range; and d) substituting the pitch and duration values of the one or more voicing sections of the natural utterance for the pitch and duration values of the one or more voicing sections of the synthetic equivalent to the natural utterance.

23. An apparatus for intonation specification in a synthetic speech system comprising:

a) means for obtaining a set of pitch and duration values of one or more voicing sections of a natural utterance;

b) means for obtaining a set of pitch and duration values of one or more voicing sections of a synthetic equivalent to the natural utterance;

c) means for aligning the one or more voicing sections of the natural utterance to the one or more voicing sections of the synthetic equivalent to the natural utterance, the means for aligning including i) means for varying voicing possibilities of the one or more voicing sections of the synthetic equivalent to the natural utterance until one or more alignments are reached between sequentially voiced and unvoiced types of the one or more voicing sections of the synthetic equivalent to the natural utterance and alternating voiced and unvoiced types of the one or more voicing sections of the natural utterance; and ii) means for sequentially aligning alternating voiced and unvoiced types of the one or more voicing sections of the natural utterance to alternating voiced and unvoiced types of the one or more voicing sections of the synthetic equivalent to the natural utterance for the best reached alignment between sequentially voiced and unvoiced types of the one or more voicing sections of the synthetic equivalent to the natural utterance and alternating voiced and unvoiced types of the one or more voicing sections of the natural utterance, wherein the best reached alignment is the alignment with the i) lowest accumulated error between the one or more voicing sections of the natural utterance and the one or more voicing sections of the synthetic equivalent to the natural utterance;

ii) fewest voicing possibilities actually varied; and iii) fewest of the one or more voicing sections of the natural utterance which fell outside a predetermined duration range; and d) means for substituting the pitch and duration values of the one or more voicing sections of the natural utterance for the pitch and duration values of the one or more voicing sections of the synthetic equivalent to the natural utterance.

24. A method for intonation specification in a synthetic speech system comprising the following steps:

a) obtaining a set of pitch and duration values of one or more voiced portions of a natural utterance;

b) obtaining a set of pitch and duration values of one or more unvoiced portions of a natural utterance;

c) obtaining a set of pitch and duration values of one or more voiced and one or more unvoiced portions of a synthetic equivalent to the natural utterance;

d) aligning the one or more voiced portions of the natural utterance to the one or more voiced and unvoiced portions of the synthetic equivalent to the natural utterance, the step of aligning including i) varying voicing possibilities of the one or more voicing sections of the synthetic equivalent to the natural utterance until one or more alignments are reached between sequentially voiced and unvoiced types of the one or more voicing sections of the synthetic equivalent to the natural utterance and alternating voiced and unvoiced types of the one or more voicing sections of the natural utterance; and ii) sequentially aligning alternating voiced and unvoiced types of the one or more voicing sections of the natural utterance to alternating voiced and unvoiced types of the one or more voicing sections of the synthetic equivalent to the natural utterance for the best reached alignment between sequentially voiced and unvoiced types of the one or more voicing sections of the synthetic equivalent to the natural utterance and alternating voiced and unvoiced types of the one or more voicing sections of the natural utterance, the best reached alignment being the alignment with the i) lowest accumulated error between the one or more voicing sections of the natural utterance and the one or more voicing sections of the synthetic equivalent to the natural utterance;

ii) fewest voicing possibilities actually varied; and iii) fewest of the one or more voicing sections of the natural utterance which fell outside a predetermined duration range; and e) substituting the pitch and duration values of the one or more voiced portions of the natural utterance for the pitch and duration values of the one or more voiced and unvoiced portions of the synthetic equivalent to the natural utterance.

* * * * *